US008833586B2

(12) United States Patent
Meyers et al.

(10) Patent No.: US 8,833,586 B2
(45) Date of Patent: Sep. 16, 2014

(54) BOTTLE CLOSURE WITH INTEGRATED FLIP TOP HANDLE

(75) Inventors: David O. Meyers, Kaysville, UT (US); Steven M. Sorensen, Alpine, UT (US)

(73) Assignee: Runway Blue, LLC, Lehi, UT (US)

( * ) Notice: Subject to any disclaimer, the term of this patent is extended or adjusted under 35 U.S.C. 154(b) by 17 days.

(21) Appl. No.: 12/762,292

(22) Filed: Apr. 16, 2010

(65) Prior Publication Data

US 2011/0253733 A1 Oct. 20, 2011

(51) Int. Cl.

*B65D 51/18* (2006.01)
*B65D 51/24* (2006.01)
*B65D 47/08* (2006.01)

(52) U.S. Cl.

CPC ..... *B65D 51/242* (2013.01); *B65D 2251/1025* (2013.01); *B65D 47/089* (2013.01); *B65D 2251/02* (2013.01); *A45F 2200/0583* (2013.01)
USPC ..... 220/254.3; 220/254.4; 220/254.5; 220/254.1; 215/395; 215/396

(58) Field of Classification Search

CPC ..... B65D 2543/00092; B65D 47/0838; B65D 47/0842; B65D 2251/1083; B65D 2251/1075; B65D 2251/20; E05D 11/10
USPC ..... 220/254.3, 254.4, 254.5, 883, 833, 849, 220/215.5, 751, 592, 254.1, 212.5, 556, 220/326, 915, 834, 835, 375; 254/131; 215/228, 395–396, 236–245, 272, 253, 215/254, 258, 284, 287, 295, 303, 304, 305, 215/306, 316, 317; 222/558, 556, 562–563; 16/425, 422, 430, 110.1

IPC ..... B65D 43/16,53/00
See application file for complete search history.

(56) References Cited

U.S. PATENT DOCUMENTS 1,037,051 A 8/1912 Ramsey
1,094,469 A * 4/1914 Pick ..... 215/235

(Continued)

FOREIGN PATENT DOCUMENTS

CH 296210 1/1954
CN 201139196 10/2008

(Continued)

OTHER PUBLICATIONS

U.S. Appl. No. 12/762,292, filed Apr. 16, 2010, Meyers, et al.

(Continued)

*Primary Examiner* — Andrew Perreault
*Assistant Examiner* — James M Van Buskirk
(74) *Attorney, Agent, or Firm* — Maschoff Brennan

(57) ABSTRACT

Closures having an integrated flip top handle for use with liquid containers and for carrying the liquid containers include an end wall, a skirt wall depending from the end wall, an outlet opening associated with the end wall, and a pivot hinge mount for pivotally mounting a flip top to the closure. The closure also includes the flip top pivotally supported by the pivot hinge mount. The flip top includes a closing member that closes the outlet opening when the flip top is in a first position, a pivot support member extending from the closing member to the pivot hinge mount and pivotally attached to the pivot hinge mount, and a carrying member extending from the closing member on a same side of the closing member as the pivot support member with a distal end that extends at least as far as the pivot hinge mount.

21 Claims, 19 Drawing Sheets

(56) References Cited

U.S. PATENT DOCUMENTS 1,389,732 A * 9/1921 Baron ..... 215/235
1,479,053 A * 1/1924 Brooks ..... 220/263
1,573,620 A 2/1926 Allston
2,056,879 A * 10/1936 Winterhalter et al. ..... 215/396
2,272,867 A 2/1942 Cobel
2,514,573 A 7/1950 Harrison
2,573,378 A * 10/1951 Zurlinden ..... 215/235
2,574,876 A 11/1951 Lebus
2,575,299 A 11/1951 Scheel
2,638,253 A 5/1953 Mueller
2,748,997 A 6/1956 Richmond, Sr.
2,752,971 A 7/1956 Tupper
2,754,866 A 7/1956 Coltman
3,022,925 A 2/1962 Daniell
3,091,361 A 5/1963 Gawron
3,143,205 A 8/1964 Ruderian
3,144,016 A 8/1964 Basci
3,163,331 A * 12/1964 Wallberg ..... 222/151
3,168,226 A * 2/1965 Underwood et al. ..... 222/472
3,369,691 A 2/1968 Wei
3,552,548 A 1/1971 Wallestad et al.
3,770,160 A 11/1973 Flider
3,820,692 A 6/1974 Swett et al.
D233,116 S 10/1974 Swett
4,022,352 A * 5/1977 Pehr ..... 222/153.14
4,136,799 A 1/1979 Albert
4,158,902 A * 6/1979 Chernack et al. ..... 16/227
D261,088 S 10/1981 Akimov et al.
4,399,926 A 8/1983 Eidels-Dubovoy
4,457,458 A * 7/1984 Heinol ..... 222/498
4,474,303 A 10/1984 Maccise
4,519,518 A 5/1985 Wiles et al.
4,537,044 A 8/1985 Putnam
4,735,333 A * 4/1988 Lay et al. ..... 220/739
4,776,501 A 10/1988 Ostrowsky
4,805,790 A 2/1989 Leonetti et al.
4,932,225 A 6/1990 Bighouse
5,065,877 A 11/1991 Karppinen et al.
5,065,911 A * 11/1991 Rohr et al. ..... 222/517
5,088,614 A 2/1992 Dumestre
D330,862 S 11/1992 Shibley et al.
5,228,584 A * 7/1993 Williams, Jr. ..... 220/3.8
D342,898 S 1/1994 Cane
5,289,930 A 3/1994 Inouye
D350,460 S 9/1994 Picozza et al.
5,386,922 A 2/1995 Jordan
D356,499 S 3/1995 Cautereels et al.
5,547,111 A 8/1996 Geiger et al.
5,609,277 A * 3/1997 McDonald ..... 224/148.3
D382,968 S 8/1997 Giles et al.
D404,305 S 1/1999 De Baschmakoff
D405,654 S 2/1999 Moran
D421,547 S 3/2000 Demers
6,161,713 A 12/2000 Krich
6,283,333 B1 9/2001 Knickerbocker et al.
6,299,005 B1 * 10/2001 Higgins ..... 215/237
6,379,032 B1 4/2002 Sorensen
D458,081 S 6/2002 Bodum
D461,420 S 8/2002 Kerman
D497,431 S 10/2004 Bentley
6,832,412 B2 12/2004 Kim
6,860,397 B1 3/2005 Walters, Jr.
D504,273 S 4/2005 Ancona
D508,185 S 8/2005 Gauss
D510,235 S 10/2005 Sorensen
6,986,434 B1 1/2006 Getsy et al.
D518,336 S 4/2006 Hirani
7,073,678 B1 7/2006 Dibdin et al.
D526,827 S 8/2006 Allen et al.
D528,862 S 9/2006 Li
D529,339 S 10/2006 Carreno et al.
D532,650 S 11/2006 de Groote
D543,454 S 5/2007 Leoncavallo et al.
D546,131 S 7/2007 Morales
D547,607 S 7/2007 Forsman
D565,353 S 4/2008 Roth et al.
D574,190 S 8/2008 Homma
D580,227 S 11/2008 Roth et al.
D586,184 S 2/2009 Miller et al.
D587,069 S 2/2009 Bodum
D589,751 S 4/2009 Liu et al.
D592,913 S 5/2009 Pinelli et al.
7,533,783 B2 5/2009 Choi et al.
D593,811 S 6/2009 Carreno
D599,664 S 9/2009 Fujinami et al.
D604,103 S 11/2009 Alviar et al.
D609,970 S 2/2010 Richau et al.
D613,110 S 4/2010 Lane et al.
D622,089 S 8/2010 Daniel et al.
D622,554 S 8/2010 Carreno
7,806,284 B2 10/2010 Mangano
D626,837 S * 11/2010 Meyers et al. ..... D9/443
D626,838 S * 11/2010 Meyers et al. ..... D9/443
D628,483 S 12/2010 McKinney et al.
D629,657 S 12/2010 Carreno
7,870,980 B2 1/2011 Wilson et al.
D641,594 S 7/2011 Huang
D644,065 S 8/2011 Llerena
8,020,257 B2 * 9/2011 Merten et al. ..... 16/442
D646,546 S 10/2011 Robinson et al.
D646,919 S 10/2011 Nilsson
D647,760 S 11/2011 Pearson
D652,256 S 1/2012 Eyal
D655,131 S 3/2012 Nilsson
D655,967 S 3/2012 Bodum
D656,357 S 3/2012 Enghard
D661,551 S 6/2012 Gilbert
D666,047 S 8/2012 Lin
D666,061 S 8/2012 Ying
D667,694 S 9/2012 Meyers et al.
8,302,796 B1 11/2012 Johnson
8,342,349 B2 1/2013 Lu
D677,121 S 3/2013 Meyers et al.
D686,885 S 7/2013 Meyers et al.
D686,886 S 7/2013 Meyers et al.
D686,887 S 7/2013 Meyers et al.
D686,888 S 7/2013 Meyers et al.
2002/0074334 A1 6/2002 Karp
2003/0085228 A1 5/2003 Oakes
2004/0217139 A1 * 11/2004 Roth et al. ..... 224/148.7
2004/0262306 A1 12/2004 Smith
2005/0045634 A1 3/2005 Ward et al.
2005/0045636 A1 3/2005 Lown et al.
2007/0012693 A1 1/2007 Kummer
2007/0175931 A1 * 8/2007 Leoncavallo et al. ..... 222/556
2008/0099514 A1 5/2008 Carter et al.
2009/0178940 A1 7/2009 Said
2009/0188884 A1 7/2009 Nelson et al.
2009/0188933 A1 7/2009 Daams
2009/0301990 A1 12/2009 Cresswell et al.
2010/0200438 A1 8/2010 Davies
2010/0206835 A1 8/2010 Yu
2010/0224631 A1 9/2010 Roth et al.
2010/0282703 A1 11/2010 Yang
2011/0017760 A1 1/2011 Newman
2011/0253733 A1 10/2011 Meyers et al.

FOREIGN PATENT DOCUMENTS

JP 2006103793 A * 4/2006 ..... B67C 11/00
JP 2008247404 A 10/2008

OTHER PUBLICATIONS

U.S. Appl. No. 13/232,891, filed Sep. 14, 2011, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/610,445, filed Sep. 11, 2012, Meyers, et al.
U.S. Appl. No. 13/633,864, filed Oct. 2, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.

(56) References Cited

OTHER PUBLICATIONS

U.S. Appl. No. 61/832,085, filed Jun. 6, 2013, Sorensen, et al.
Notice of Allowance from U.S. Appl. No. 29/430,882 dated Aug. 5, 2013.
Notice of Allowance from U.S. Appl. No. 29/431,544 dated Aug. 14, 2013.
Office Action from U.S. Appl. No. 29/431,544 dated Mar. 25, 2013.
Office Action from U.S. Appl. No. 13/610,445 dated Mar. 29, 2013.
Office Action from U.S. Appl. No. 13/633,864 dated Mar. 29, 2013.
Office Action from U.S. Appl. No. 13/232,891 dated Jul. 19, 2013.
Office Action from U.S. Appl. No. 13/609,238 dated May 30, 2013.
International Search Report from PCT Application No. PCT/US2011/026508 dated Sep. 29, 2011.
Written Opinion from PCT Application No. PCT/US2011/026508 dated Sep. 29, 2011.
International Preliminary Report on Patentability from PCT Application No. PCT/US2011/026508 dated Oct. 16, 2012.
International Search Report from PCT Application No. PCT/US2012/054483 dated Nov. 16, 2012.
International Search Report and Written Opinion from PCT Application No. PCT/US2012/054497 dated Nov. 20, 2012.
International Search Report and Written Opinion from PCT Application No. PCT/US2013/052132 dated Aug. 16, 2013.
KOR ONE, http://www.korwater.com/buyONE, accessed Apr. 21, 2010.
Core 77, http://www.core77.com/blog/materials/kor_one_water_vessel_actual_size_10211.asp, accessed Apr. 21, 2010.
Koyono, http://www.koyono.com/KOR-ONE-Green-Zen-Water-Hydration-Vessel_p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.
Goodlifter, http://www.goodlifer.com/2009/02/360-paper-water-bottle/, accessed Apr. 21, 2010.
European Search Report and Search Opinion from European Application No. 11769233, dated Jan. 8, 2014.

* cited by examiner

BOTTLE CLOSURE WITH INTEGRATED FLIP TOP HANDLE

BACKGROUND OF THE INVENTION

1. Field of the Invention

The present invention relates to closures incorporating an integrated handle, and more particularly to closures with integrated handles for liquid containers such as bottles.

2. Background and Related Art

Various types of bottles or containers have been developed in the past that include a closure to provide selective dispensing of liquid from the container. Typically, the closure is removably attached to the neck of the container so a user can remove the closure to add liquid, powders, ice or other products into the container. The closure is then screwed or snapped onto the neck of the container to provide a generally watertight and leak-proof seal.

When a user desires to drink liquid from the container, the closure may be removed by unscrewing the closure to provide access into the reservoir of the container. The user drinks from an opening formed by the neck of the container and then replaces the closure onto the container to re-seal the container. In some instances, such as for outdoor activities (biking or hiking being examples), it is oftentimes desirable to have a closure provided with an outlet for faster access than that obtained by completely removing the closure, such as a push/pull spout or a flip top.

Users can carry containers or bottles by grasping the container itself or by grasping the container or bottle from the top, often around the closure. This can be cumbersome, especially if the user also needs to carry other items at the same time. It can also be uncomfortable due to cooling/heating of the container or bottle due to the temperature of the contained contents. When contents of the container or bottle are cold and the container or bottle is used in a humid environment, condensation on the outside of the container may make the container wet and slippery to hold.

As a result, manufacturers have started making containers or bottles with integrated handles. Such handles allow users to carry the container/bottle with as little as one finger, which is easier and more convenient, especially when carrying other items. Such handles minimize heat or cold transfer to the user from the container's contents, and minimize the concerns caused by condensation. Integrated handles also permit attachment of the container or bottle to other items such as bags, belts, and the like using hooks, ties, carabiners, etc. for convenient, hands-free transportation. However, obtaining access to a bottle or other container while its integrated handle is attached to another item can be cumbersome.

Flip top closures are convenient and provide one way to easily and quickly access container/bottle contents; however, because the cap snaps over a spout opening and is secured by tension/friction, the flip top closure is not as secure as a screw-type closure. Flip top closures are typically opened by pressing on a front of the flip top in an upward motion until the upward pressure is sufficient to overcome the friction/tension holding the flip top closure sealed against the spout. Because flip top closures open and release through upward pressure, manufacturers have not attached handles to the flip tops for fear that carrying the container/bottle by the handle would create upward pressure on the flip top and cause the flip top to open at an unwanted time. Therefore, to date, integrated handles have been attached directly to the containers/bottles themselves and/or to non-flip top closures and portions thereof such as to screw lids.

BRIEF SUMMARY OF THE INVENTION

A bottle/container closure with an integrated flip top handle is described.

Implementation of the invention provides a lid with a spout opening that is closed by a flip top with an integrated handle. The flip top is attached to the lid by a pivot mount hinge located adjacent the spout on the top of the lid. The flip top includes an axis pivotally attached to the lid at the pivot mount hinge, which allows the flip top to pivot from a closed and sealed position to an open position that allows access to the contents of the container. The flip top includes a handle generally to one side of the flip top axis, and a spout closure to the opposite side of the flip top axis. The spout closure forms a seal with the spout (such as along the inside of the spout) and, when closed, is held in place by tension/friction between the spout closure and the spout.

The handle (or other carrying member) is formed of a loop or other shape extending to a side of the flip top axis away from the spout closure. The handle may also extend upwardly above the flip top axis when the flip top is closed. The handle or other carrying member is therefore attached to or formed in the flip top in such a way that a downward pressure is transferred to the spout closure when upward (carrying) pressure is applied to the handle or other carrying member. This leveraged handle flip top design enables the bottle or other container to be carried by the handle or other carrying member of the flip top without risk of the spout closure opening unexpectedly. Upward (carrying) pressure exerted on the handle or other carrying member does not cause opening of the flip top. Instead, either no net force is translated to the spout closure, or a downward (closing) force is translated to the spout closure by locating the handle/carrying member/carrying point of the flip top above to behind the flip top axis (as viewed when the flip top is closed).

Thus, implementation of the invention provides a closure having an integrated flip top handle for use with a liquid container and for carrying the liquid container. The closure includes an end wall, a skirt wall depending from the end wall, an outlet opening associated with the end wall, and a pivot hinge mount for pivotally mounting a flip top to the closure. The closure also includes the flip top, which is pivotally supported by the pivot hinge mount, the flip top being movable between a first position in which the outlet opening is covered by the flip top and a second position in which the outlet opening is exposed. The flip top includes a closing member configured to close the outlet opening when the flip top is moved to the first position, a pivot support member extending from the closing member to the pivot hinge mount and pivotally attached to the pivot hinge mount, and a carrying member extending from the closing member on a same side of the closing member as the pivot support member. The carrying member has a distal end that, when the flip top is in the first position, extends outward from the closing member at least as far as the pivot hinge mount, whereby an upward force applied to the distal end when the flip top is in the first position does not cause an upward opening force to be applied to the closing member.

Further implementation of the invention provides a closure having an integrated flip top handle for use with a liquid container and for carrying the liquid container. The closure includes an end wall, a skirt wall depending from the end wall, an outlet opening associated with the end wall, and a pivot hinge mount for pivotally mounting a flip top to the closure. The flip top is pivotally supported by the pivot hinge mount and is movable between a first position in which the outlet opening is covered by the flip top and a second position in which the outlet opening is exposed. The flip top includes a carrying member for carrying the liquid container, whereby the liquid container may be carried by the carrying member when the liquid container is full of liquid.

The closure is configured to be removably secured to a neck of a liquid container such as a bottle and to provide an essentially liquid-tight and leak-proof seal with the container neck. The outlet opening permits access to the liquid contents, and the flip top reversibly seals the outlet opening to keep the liquid contents in the container and prevent spillage. The flip top also includes a carrying portion whereby the liquid container may be carried by a user holding only the flip top, and no other portion of the closure or the container.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
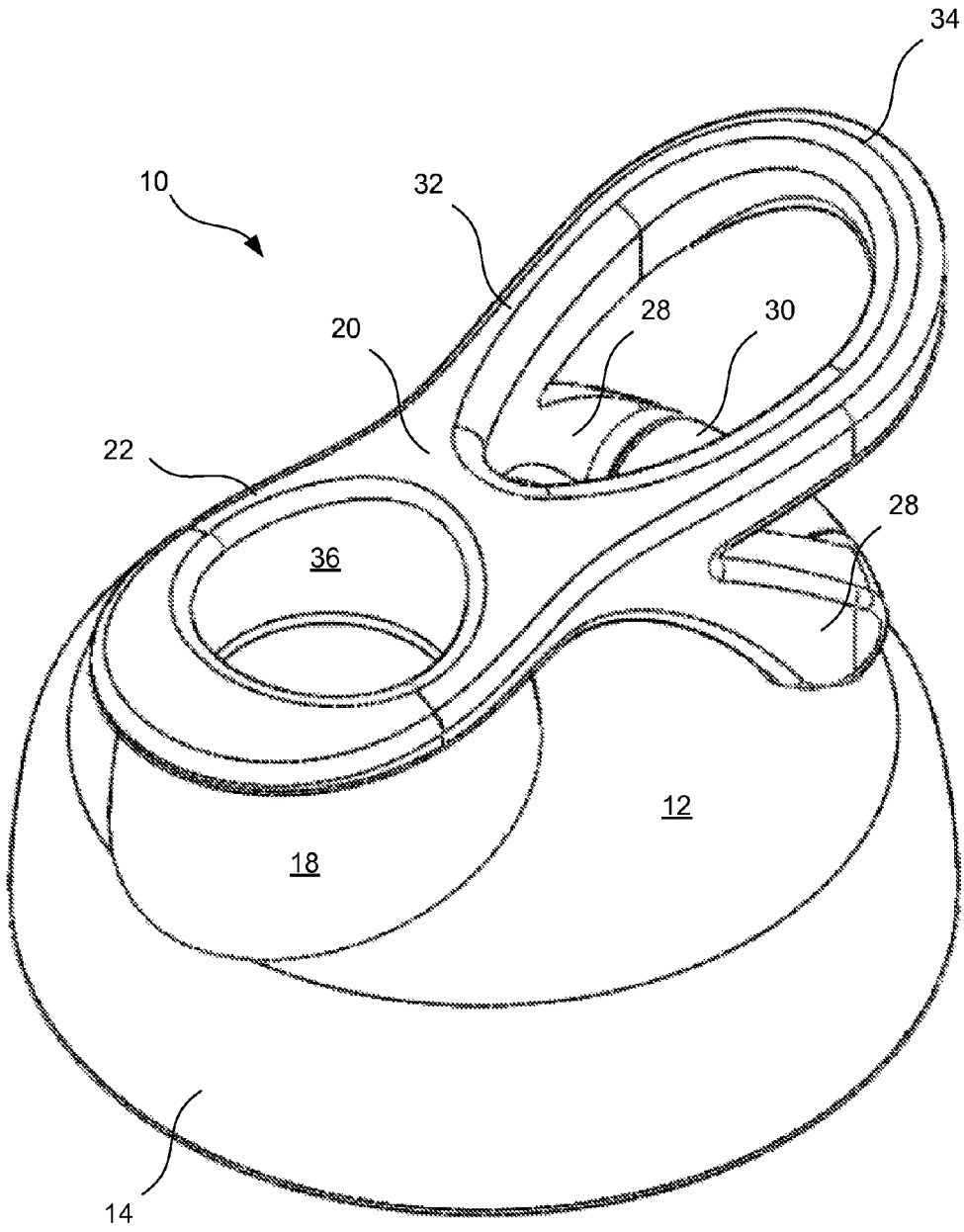
FIG. 1 shows a perspective view of an embodiment of a bottle closure with a flip top in a closed position.
Figure 2:
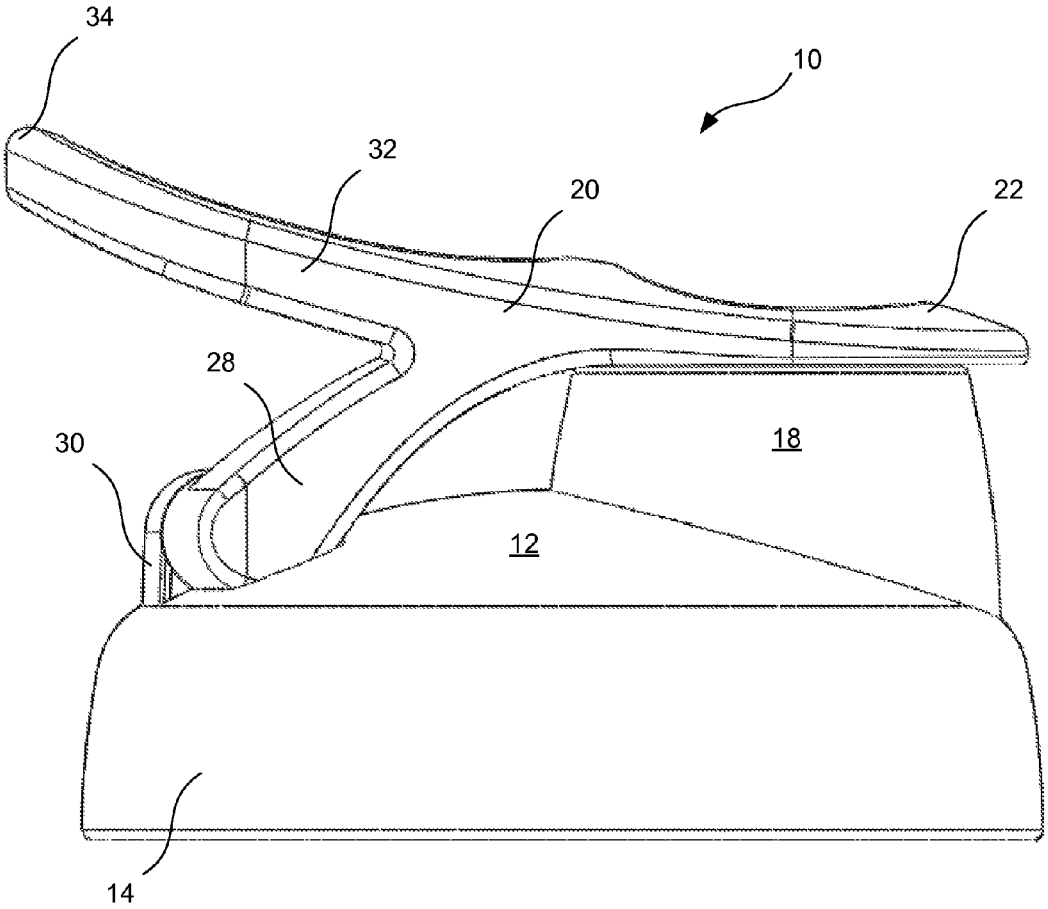
FIG. 2 shows a right-side view thereof.
Figure 3:
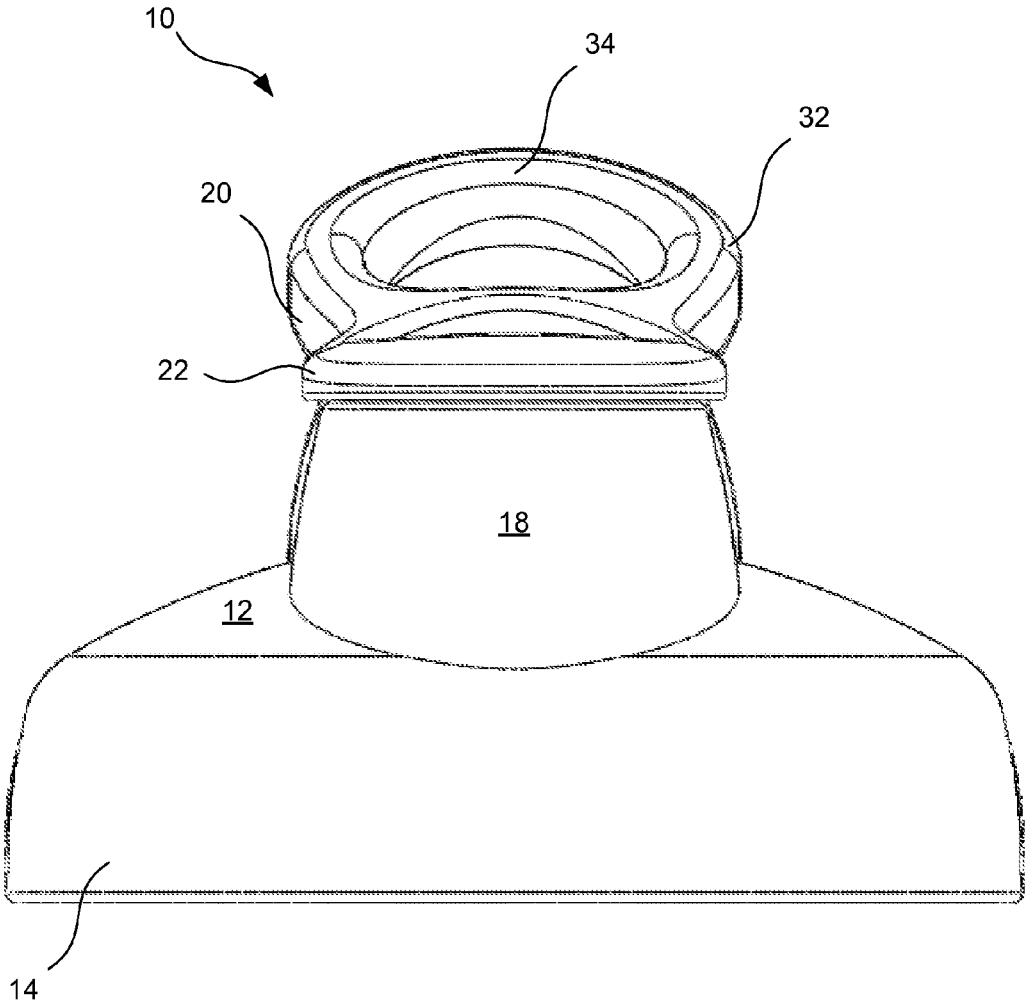
FIG. 3 shows a front view thereof.
Figure 4:
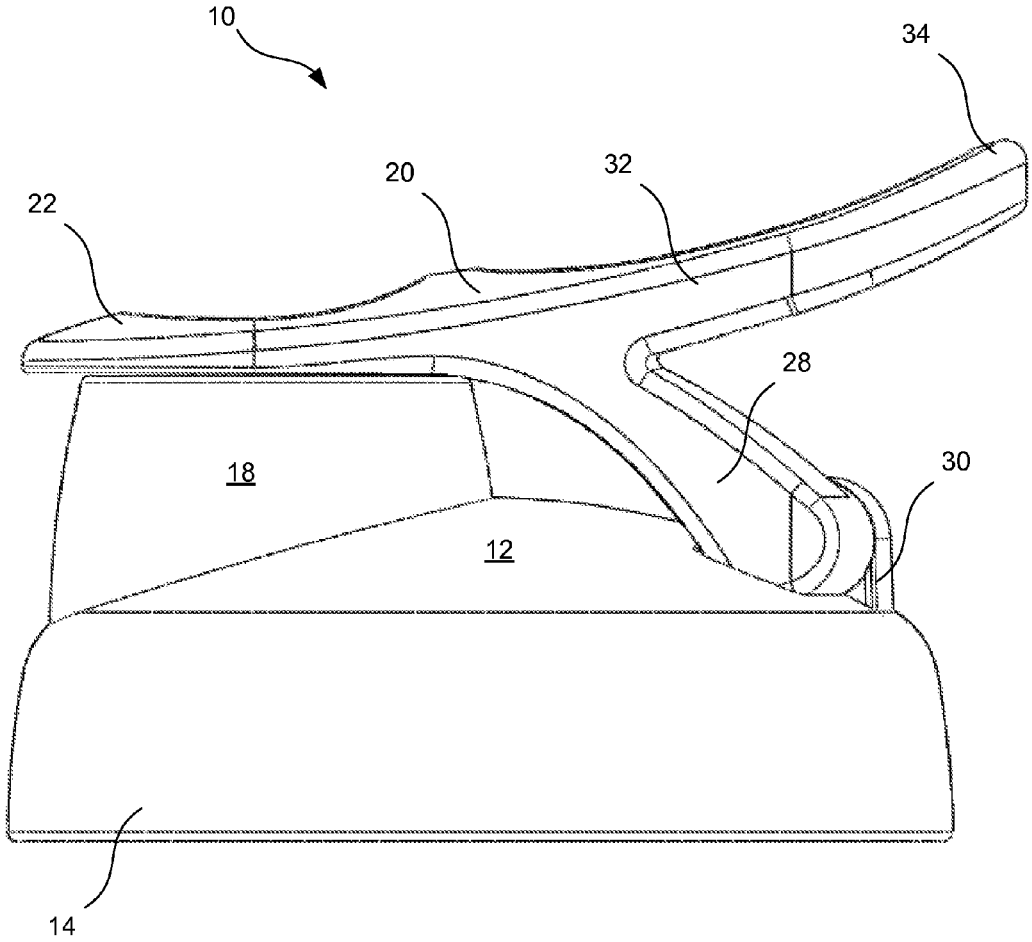
FIG. 4 shows a left-side view thereof.
Figure 5:
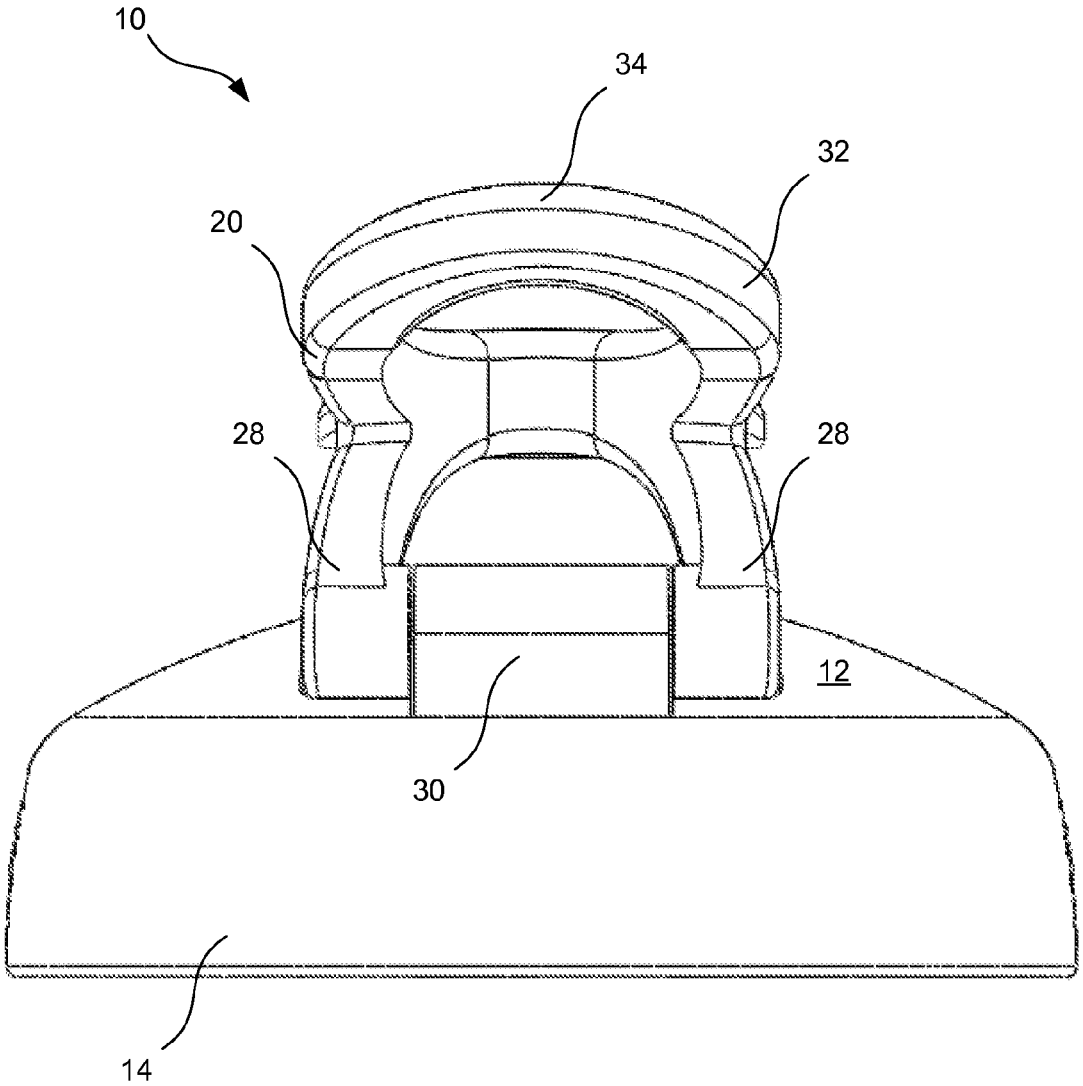
FIG. 5 shows a back view thereof.
Figure 6:
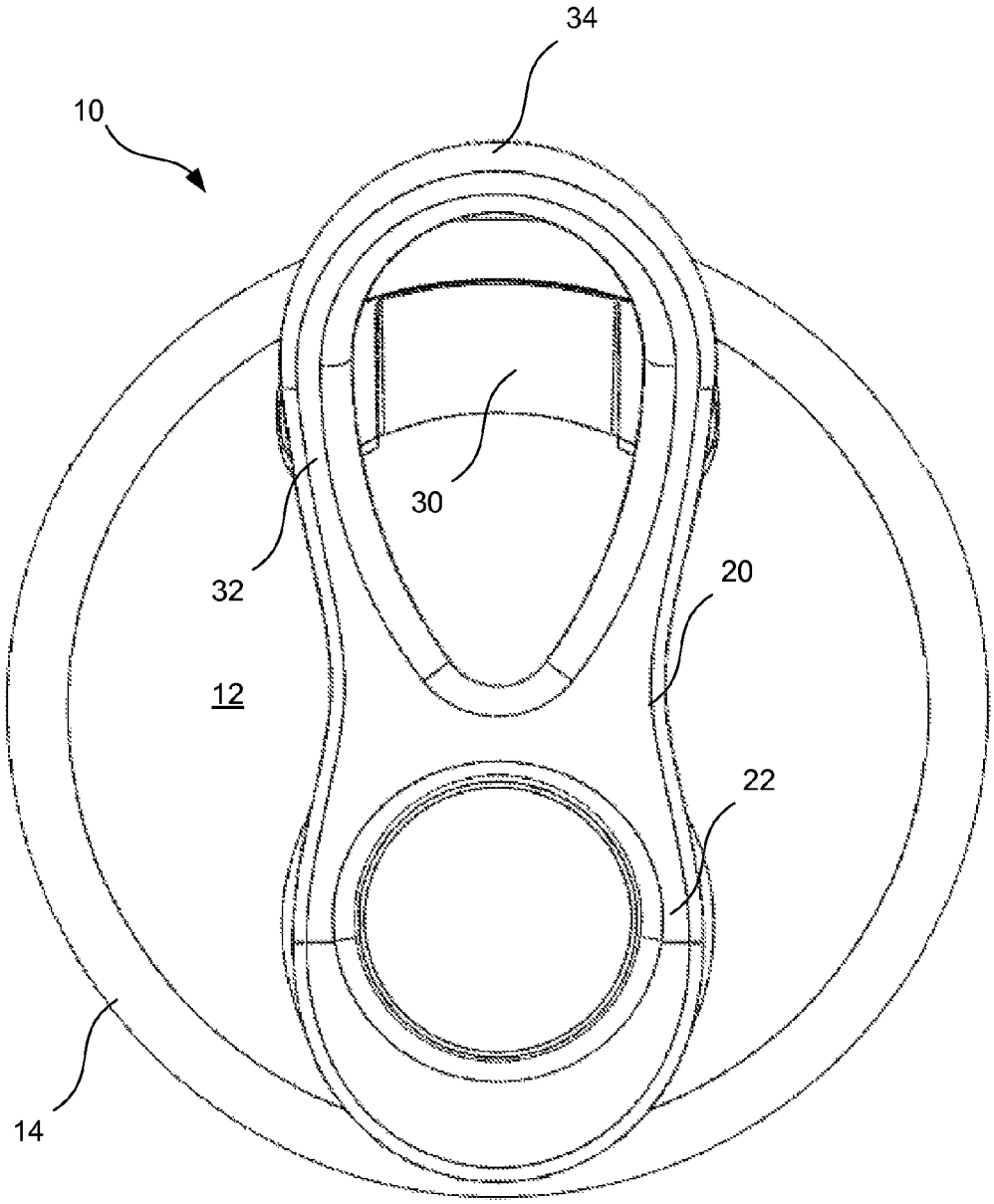
FIG. 6 shows a top view thereof.
Figure 7:
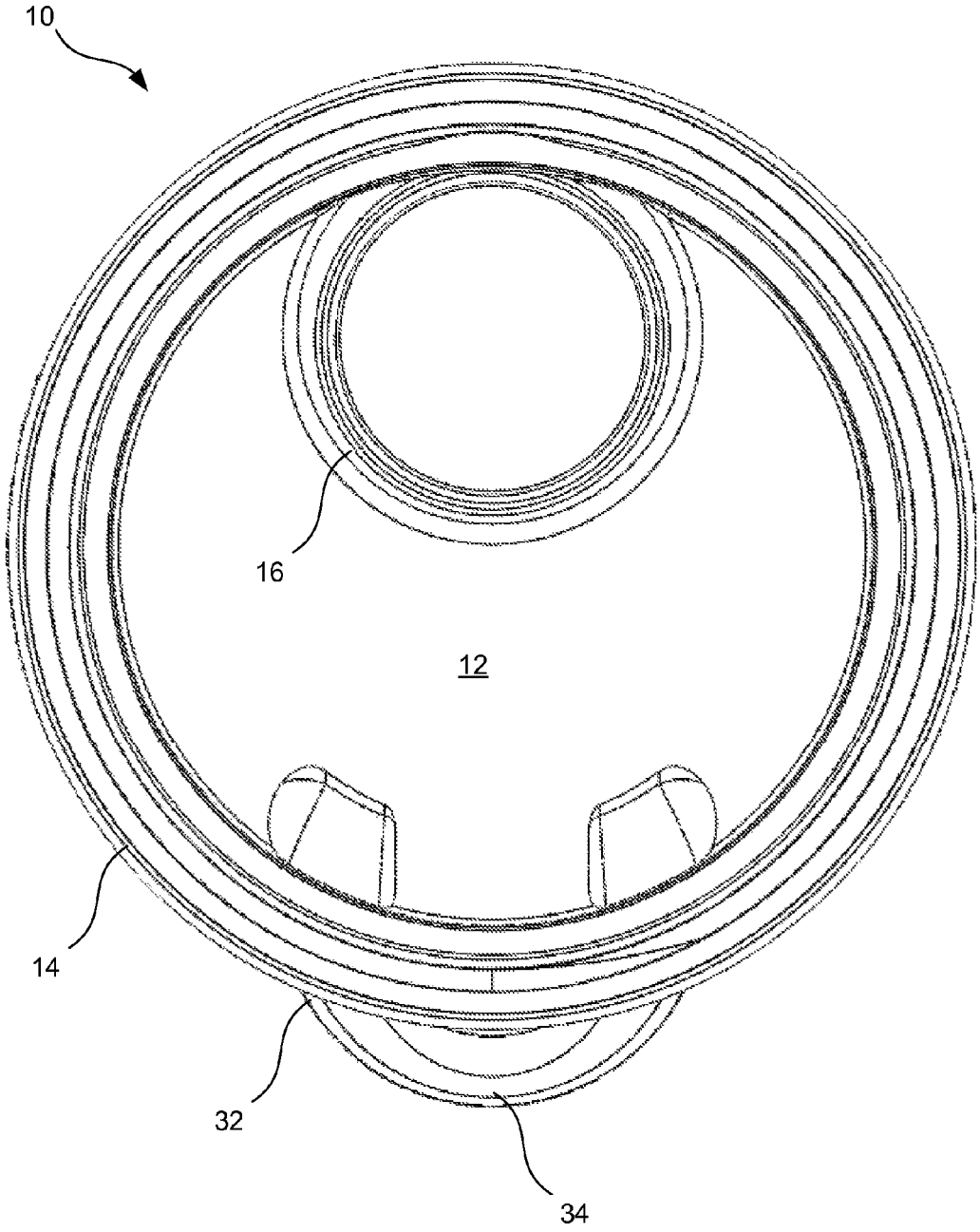
FIG. 7 shows a bottom view thereof.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a lid with a spout opening that is closed by a flip top with an integrated handle. The flip top is attached to the lid by a pivot mount hinge located adjacent the spout on the top of the lid. The flip top includes an axis pivotally attached to the lid at the pivot mount hinge, which allows the flip top to pivot from a closed and sealed position to an open position that allows access to the contents of the container. The flip top includes a handle generally to one side of the flip top axis, and a spout closure to the opposite side of the flip top axis. The spout closure forms a seal with the spout (such as along the inside of the spout) and, when closed, is held in place by tension/friction between the spout closure and the spout.

The handle (or other carrying member) is formed of a loop or other shape extending to a side of the flip top axis away from the spout closure. The handle may also extend upwardly above the flip top axis when the flip top is closed. The handle or other carrying member is therefore attached to or formed in the flip top in such a way that a downward pressure is transferred to the spout closure when upward (carrying) pressure is applied to the handle or other carrying member. This leveraged handle flip top design enables the bottle or other container to be carried by the handle or other carrying member of the flip top without risk of the spout closure opening unexpectedly. Upward (carrying) pressure exerted on the handle or other carrying member does not cause opening of the flip top. Instead, either no net force is translated to the spout closure, or a downward (closing) force is translated to the spout closure by locating the handle/carrying member/carrying point of the flip top above to behind the flip top axis (as viewed when the flip top is closed).

Embodiments of the invention provide a closure having an integrated flip top handle for use with a liquid container and for carrying the liquid container. The closure includes an end wall, a skirt wall depending from the end wall, an outlet opening associated with the end wall, and a pivot hinge mount for pivotally mounting a flip top to the closure. The closure also includes the flip top, which is pivotally supported by the pivot hinge mount, the flip top being movable between a first position in which the outlet opening is covered by the flip top and a second position in which the outlet opening is exposed. The flip top includes a closing member configured to close the outlet opening when the flip top is moved to the first position, a pivot support member extending from the closing member to the pivot hinge mount and pivotally attached to the pivot hinge mount, and a carrying member extending from the closing member on a same side of the closing member as the pivot support member. The carrying member has a distal end that, when the flip top is in the first position, extends outward from the closing member at least as far as the pivot hinge mount, whereby an upward force applied to the distal end when the flip top is in the first position does not cause an upward opening force to be applied to the closing member.

Further embodiments of the invention include a closure having an integrated flip top handle for use with a liquid container and for carrying the liquid container. The closure includes an end wall, a skirt wall depending from the end wall, an outlet opening associated with the end wall, and a pivot hinge mount for pivotally mounting a flip top to the closure. The flip top is pivotally supported by the pivot hinge mount and is movable between a first position in which the outlet opening is covered by the flip top and a second position in which the outlet opening is exposed. The flip top includes a carrying member for carrying the liquid container, whereby the liquid container may be carried by the carrying member when the liquid container is full of liquid.

The various embodiments of the closure are configured to be removably secured to a neck of a liquid container such as a bottle and to provide an essentially liquid-tight and leak-proof seal with the container neck. The outlet opening permits access to the liquid contents, and the flip top reversibly seals the outlet opening to keep the liquid contents in the container and prevent spillage. The flip top also includes a carrying portion whereby the liquid container may be carried by a user holding only the flip top, and no other portion of the closure or the container.

FIG. 1 shows a perspective view of one embodiment of a closure 10 for use with a liquid container. The closure 10 includes an end wall 12 and a skirt wall 14 depending from the end wall 12. The end wall 12 and the skirt wall 14 serve to close a liquid container (not shown), such as a bottle, and the skirt wall 14 may include any means for securing the closure 10 to the liquid container, such as threads, a ridge for a press or snap fit, or any similar structure, as known in the art. The closure 10 includes an outlet opening 16 (e.g. a spout) associated with the end wall 12. The outlet opening 16 provides access to the contents of the liquid container without requiring removal of the entire closure 10 from the liquid container. In the embodiment illustrated in the Figures, the outlet opening 16 terminates a spout 18 extending from the end wall 12.

Figure 8:
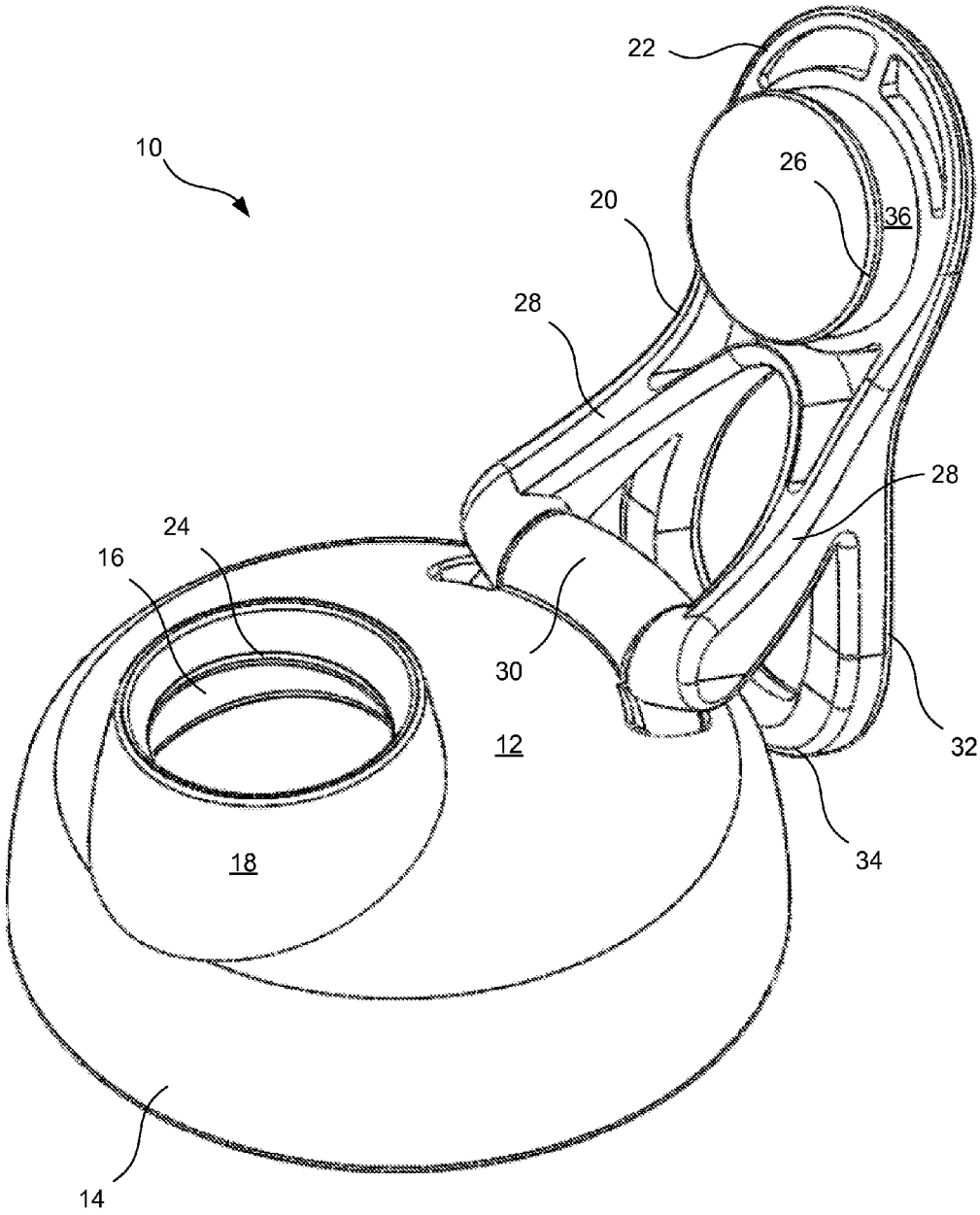
FIG. 8 shows a perspective view of the embodiment of FIG. 1 with the flip top in an open position.
Figure 9:
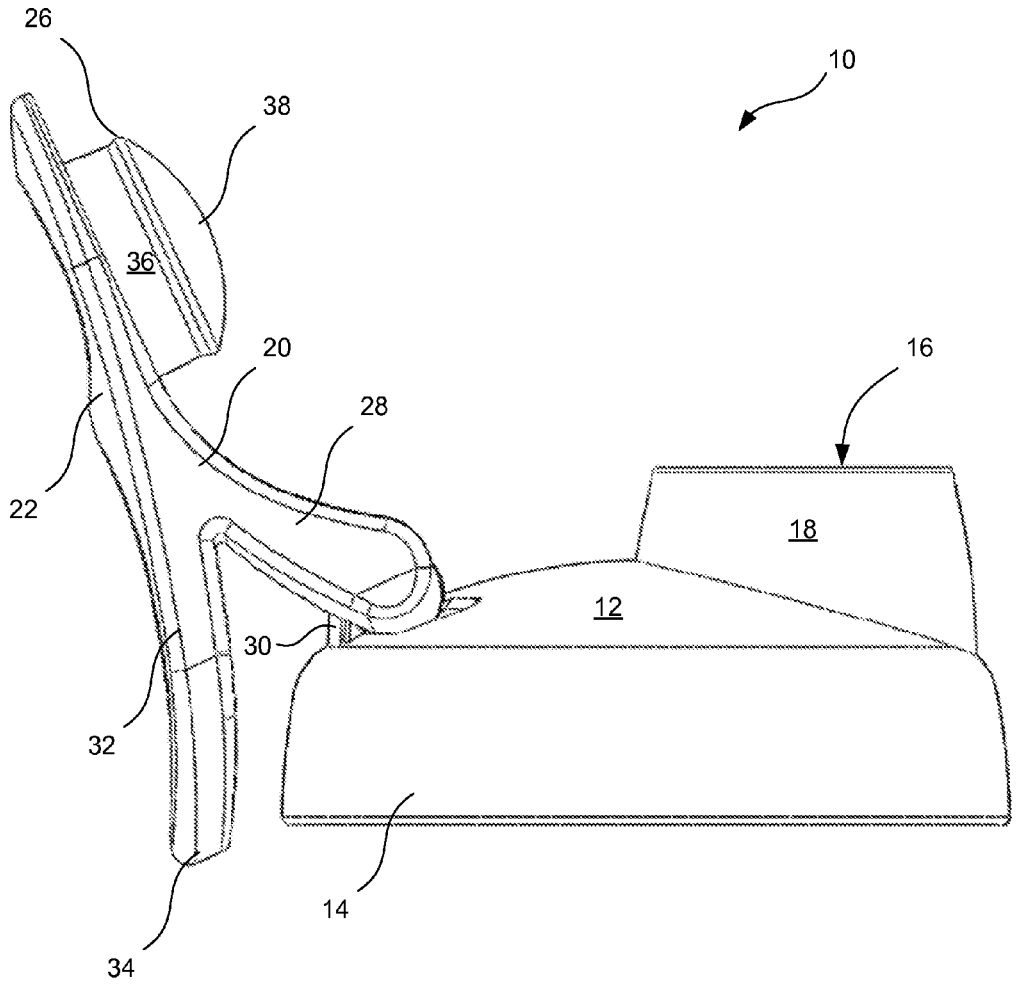
FIG. 9 shows a right-side view thereof.
Figure 10:
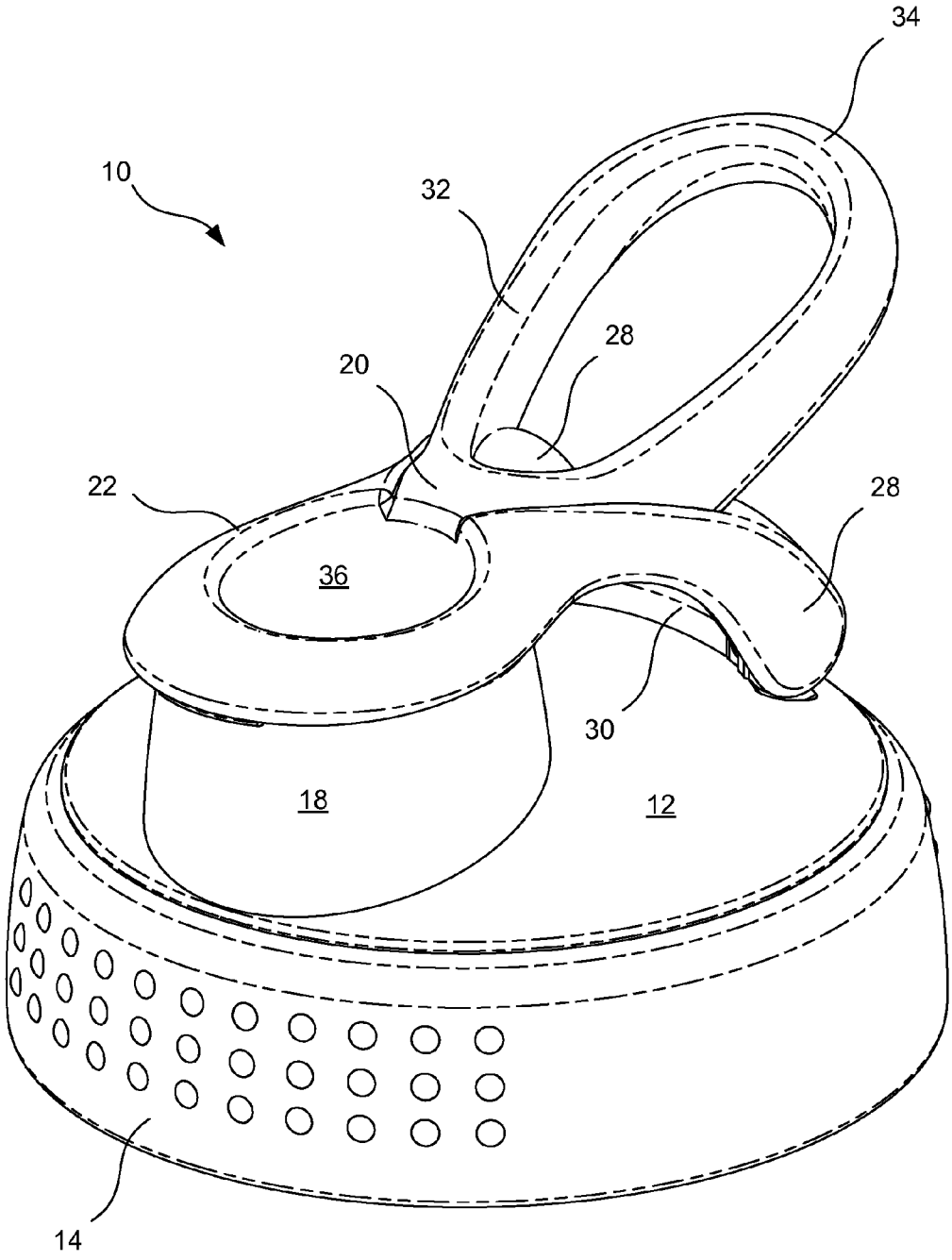
FIG. 10 shows a perspective view of an alternate embodiment of a bottle closure with a flip top in a closed position.
Figure 11:
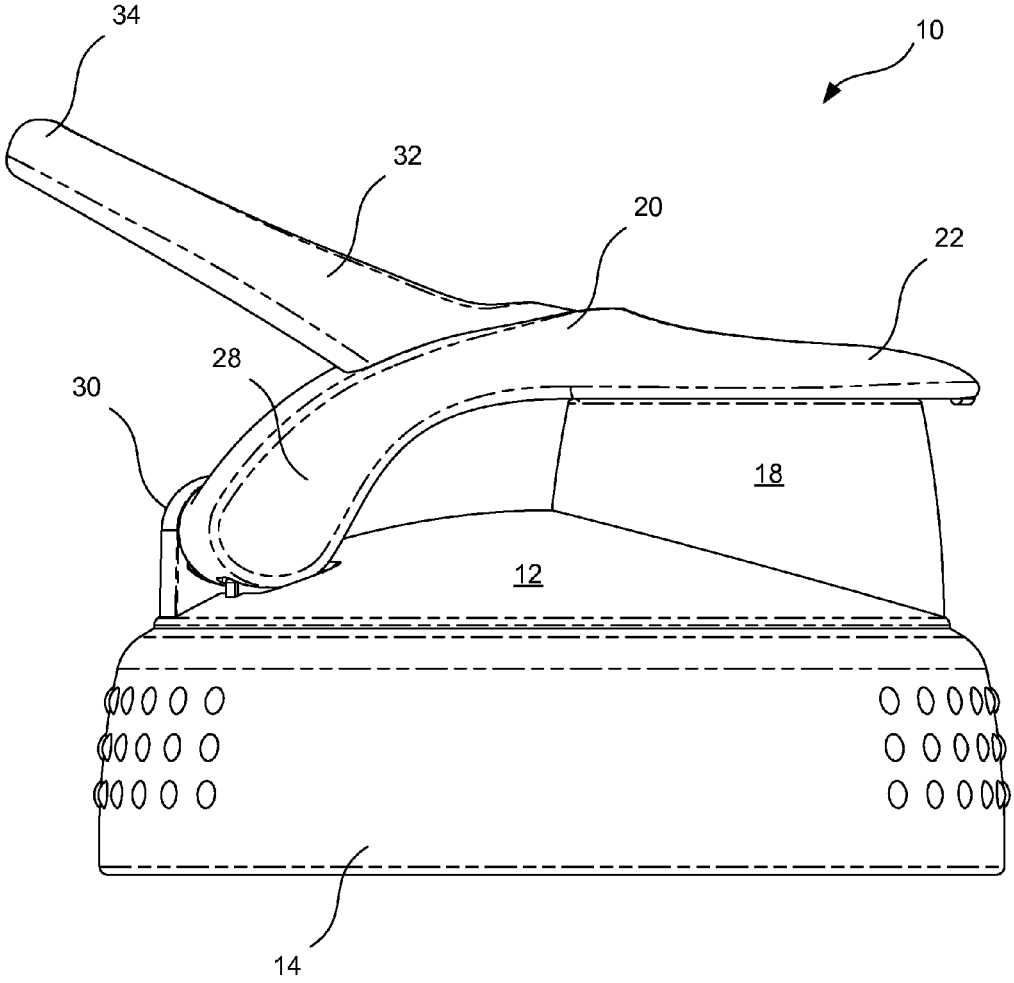
FIG. 11 shows a right-side view thereof.

The outlet opening 16 is reversibly sealable by a flip top 20, which is shown in a first position in FIGS. 1-7 and in a second position in FIGS. 8-9. When the flip top 20 is in the first position, the flip top 20 covers the outlet opening 16. When the flip top 20 is in the second position, the outlet opening 16 is exposed, allowing access to the contents of the liquid container through the outlet opening 16.

The flip top 20 includes a closing member 22 or spout closure configured to seal with or otherwise close the outlet opening 16 when the flip top 20 is moved to the first position. To facilitate sealing of the outlet opening 16, the outlet opening 16 may include an outlet opening ridge 24, and the closing member 22 may include a complementary closing member ridge 26, as best seen in FIGS. 8 and 9. The closing member ridge 26 is configured to engage the outlet opening ridge 24 and assist in sealing the outlet opening 16, and the outlet opening ridge 24 and the closing member ridge 26 may be shaped to facilitate sealing of the outlet opening while simultaneously securing the flip top 20 in the first (closed) position. As may be appreciated, a wide variety of mechanisms (including mechanisms not specifically illustrated) may be used to ensure sealing of the closing member 22 with the outlet opening 16, including a variety of ridges, a close frictional fit, a flexible sealing material disposed on one of the closing member 22, the outlet opening 16, or the spout 18, and the like.

The illustrated flip top 20 also includes a pivot support member 28 extending from the closing member 22 to a pivot hinge mount 30 associated with the end wall 12 near the skirt wall 14. The pivot hinge mount 30 and the pivot support member 28 allow the flip top 20 to be pivotally mounted to a body portion of the closure 10 at a flip top axis around which the flip top 20 rotates. The body portion of the closure may be formed of the end wall 10, the skirt wall 12, the spout 18 (if any), and the pivot hinge mount 30. The body portion may be manufactured in substantially one piece by a variety of methods known in the art, such as those used with forming pieces of plastic. The flip top 20 may also be manufactured in substantially one piece using such methods.

The flip top 20 may be pivotally mounted to the body portion while the flip top 20 is still hot from the forming process. When the flip top 20 is made of or includes a plastic in the pivot support member 28, the plastic is often somewhat more-easily deformable shortly after the forming process. Taking advantage of this plasticity, the pivot support member 28 may be more-easily flexed to allow a projecting tab portion (not shown) of the pivot support member 28 to enter a hole (not shown) in the pivot hinge mount 30 of the body portion. (Alternatively, a projecting tab portion of the pivot hinge mount 30 of the body portion may enter a hole in the pivot support member 28.) Once the flip top 20 cools and the plastic is less deformable, it becomes more difficult to inadvertently remove the projecting tab portion from the hole of the pivot hinge mount 30 (although it may be possible to purposefully remove the projecting tab portion from the hole if it is desired to do so). Thus, the flip top 20 may be securely mounted to the body portion. Additional features may be incorporated to further prevent inadvertent removal of the flip top 20 during carrying, as will be discussed in more detail below.

As shown in the Figures, the flip top 20 includes two pivot support members 28, each being configured to pivotally engage opposite sides of the pivot hinge mount 30 (and, in some embodiments, thus having projecting tab portions projecting toward each other). When the flip top 20 is in the first (closed) position, the pivot support members 28 extend horizontally and downward from the closing member 22 to the pivot hinge mount 30, allowing the closing member 22 to engage the outlet opening 16 of the spout 18.

The flip top 20 also includes a carrying member 32 or other handle. The carrying member 32 extends from the closing member 22 on a same side of the closing member 22 as the pivot support member 28. The carrying member 32 has a distal end 34 located distal the closing member 22. When the flip top 20 is in the first position (e.g. closed), the distal end 34 extends outward from the closing member at least as far as the pivot hinge mount 30, whereby an upward force applied to the distal end 34 when the flip top 20 is in the first position does not cause an upward opening force to be applied to the closing member 22. An upward force applied to the carrying member 32 at some locations may cause a minimal upward force to be applied to the closing member 22, but such force is not strong enough to be an opening force that would cause the flip top to move out of the first position where the outlet opening 16 is sealed closed, and the carrying member 32 may be designed to minimize the possibility of upward forces applied at such locations of the carrying member 32. Therefore, the liquid container may be carried by the carrying member, even when the liquid container is filled with liquid, without worrying about the liquid container inadvertently opening.

In the embodiment illustrated in the Figures, the distal end 34 (when the flip top 20 is in the first position) protrudes outward from the closing member 22 substantially past the pivot hinge mount 30, whereby an upward force applied to the distal end is actually translated into a downward force on the closing member 22. This is due to the pivotal mounting of the flip top 20 at the pivot hinge mount 30, which translates pivoting leverage applied to the carrying member 32 to the closing member 22. Thus, the carrying member 32 is generally to one side of the flip top axis and the closing member 22 is to the opposite side of the flip top axis. In such embodiments, this translation of a carrying force applied to a portion of the carrying member 32 into what amounts to a closing force at the closing member 22 further ensures that the flip top 20 will not inadvertently flip open when the liquid container is being carried.

As shown in the Figures, the carrying member 32 may form a carrying loop or handle that may be configured to receive a user's finger or fingers inserted therein. In the embodiment illustrated in the Figures, the carrying loop is configured to receive a user's finger inserted through the carrying loop in a generally-vertical orientation (i.e. the carrying loop, when the flip top 20 is in the first position, is roughly horizontal). However, other embodiments are envisioned where the carrying loop may be rotated to other orientations other than the orientation shown, so that when the flip top 20 is in the first position, the carrying loop is configured or oriented to receive a user's finger or fingers in a generally-horizontal orientation or in an orientation rotated between generally vertical and generally horizontal. As the carrying loop/carrying member 32 is designed to permit carrying of the liquid container, the carrying member 32/carrying loop and any other components of the flip top 20 are designed to be sufficiently strong to support carrying of the liquid container when the liquid container is full of liquid.

As may be most clearly seen in FIG. 9, when the flip top 20 is in the second position, the distal end 34 may be located proximate a lower end of the skirt wall 14. As may be seen, when the flip top 20 is in this second position, the flip top 20 is well away from the spout 18 and the outlet opening 16. This facilitates easy access to the contents of the liquid container, as the flip top 20 does not obstruct access to the spout 18 and the outlet opening 16.

As may be seen in the Figures, the closing member 22 may include a generally-tubular closure wall 36. The closing member 22 may also include a plug seal 38 supported by the closure wall 36. The plug seal 38 may be configured to seal with and close the outlet opening 16 of the spout 18 when the flip top 20 is moved to the first position. Therefore, one of the closure wall 36 and the plug seal 38 may include the closing member ridge 26.

FIGS. 10-19 illustrate another embodiment of the closure 10. The embodiment shown in FIGS. 10-19 includes similar features as the embodiment shown in FIGS. 1-9. This embodiment includes elements such as the pivot support member 28 and the carrying member 32 that are disposed at slightly different angles and/or have different curvatures than the similar elements of the embodiment shown in FIGS. 1-9, illustrating one way in which such elements may be varied while still achieving the functionality and advantages described herein. Other modifications not specifically illustrated in the Figures are embraced as falling within the scope of the claimed invention as set forth in the following claims.

Figure 15:
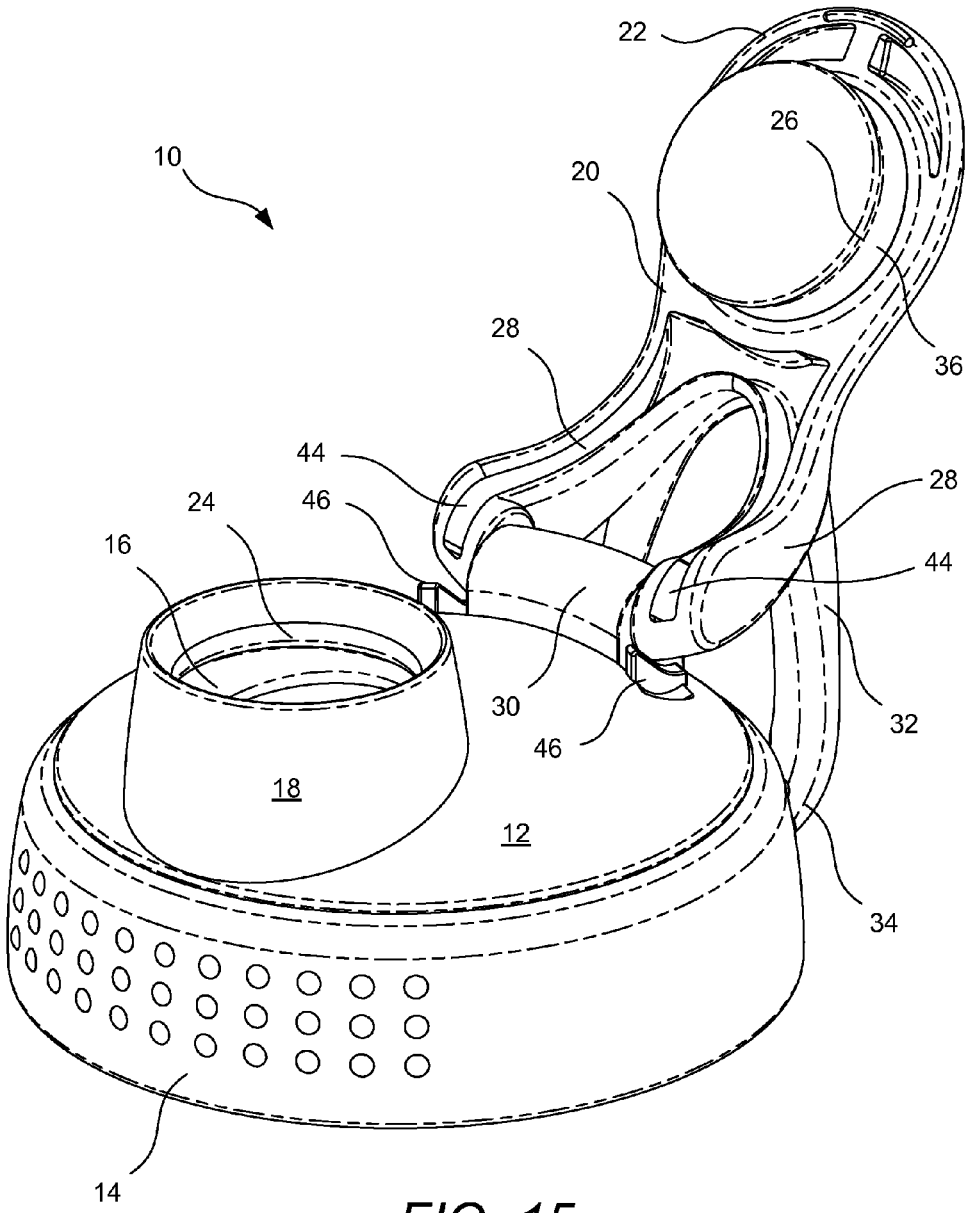
FIG. 15 shows a perspective view of the embodiment of FIG. 10 with the flip top in an open position.
Figure 16:
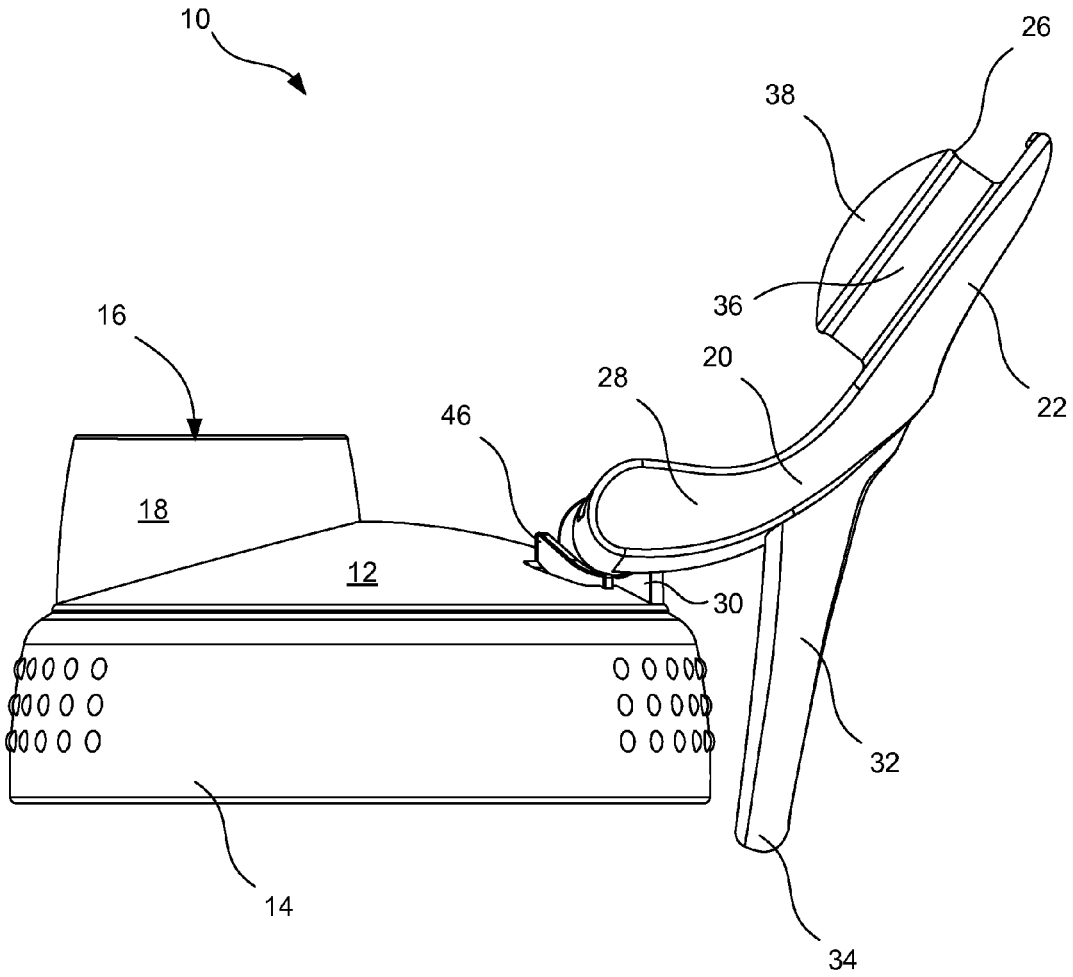
FIG. 16 shows a left-side view thereof.
Figure 17:
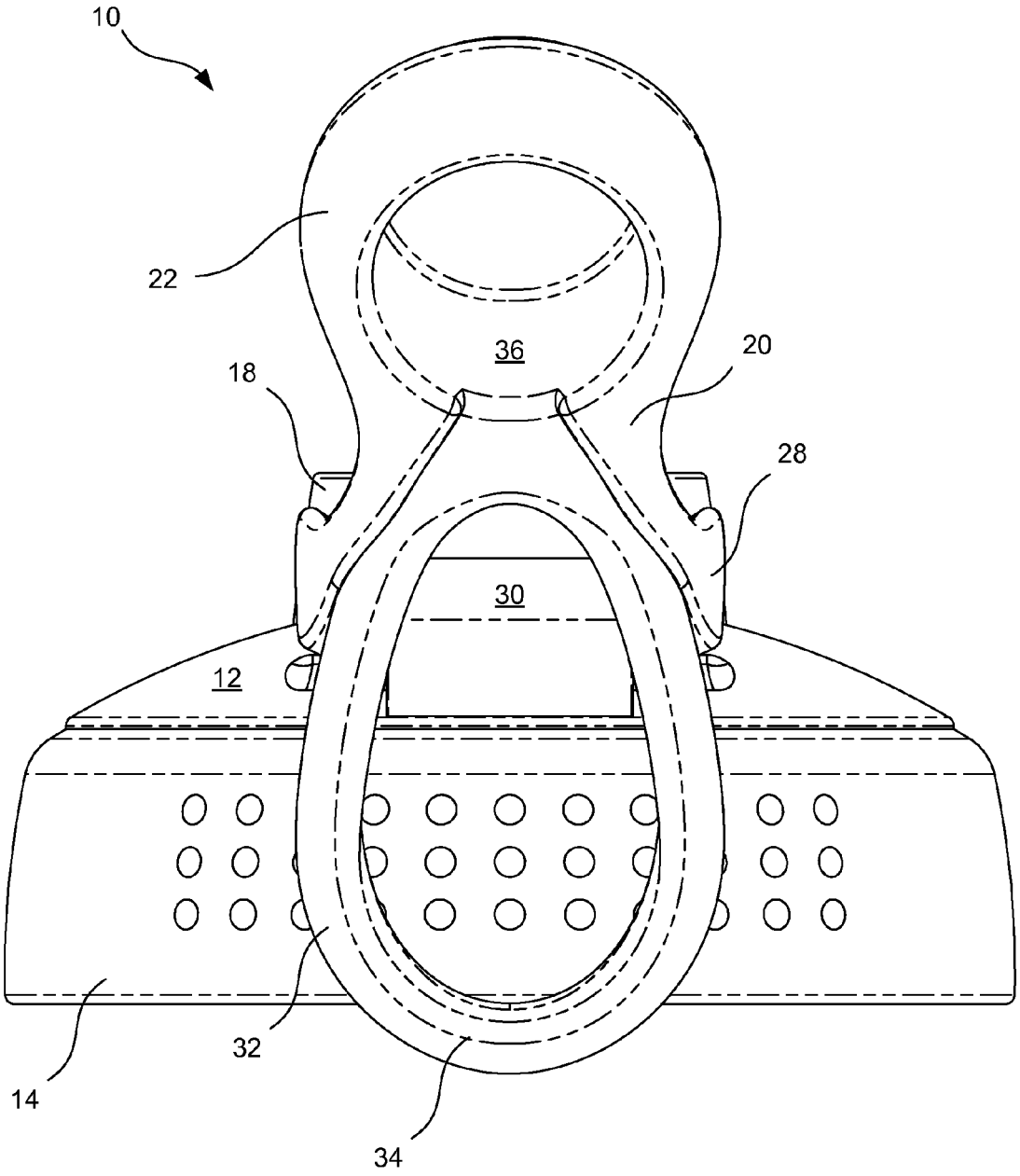
FIG. 17 shows a back view thereof.
Figure 18:
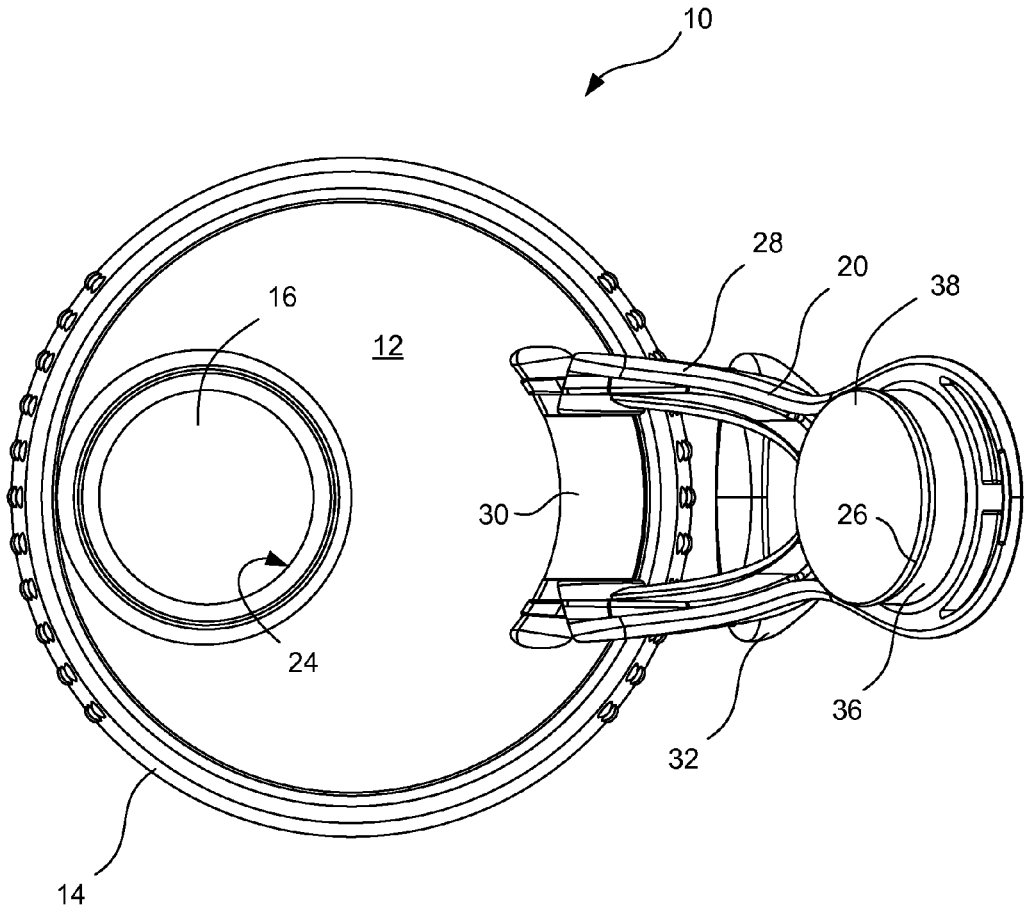
FIG. 18 shows a top view thereof.
Figure 19:
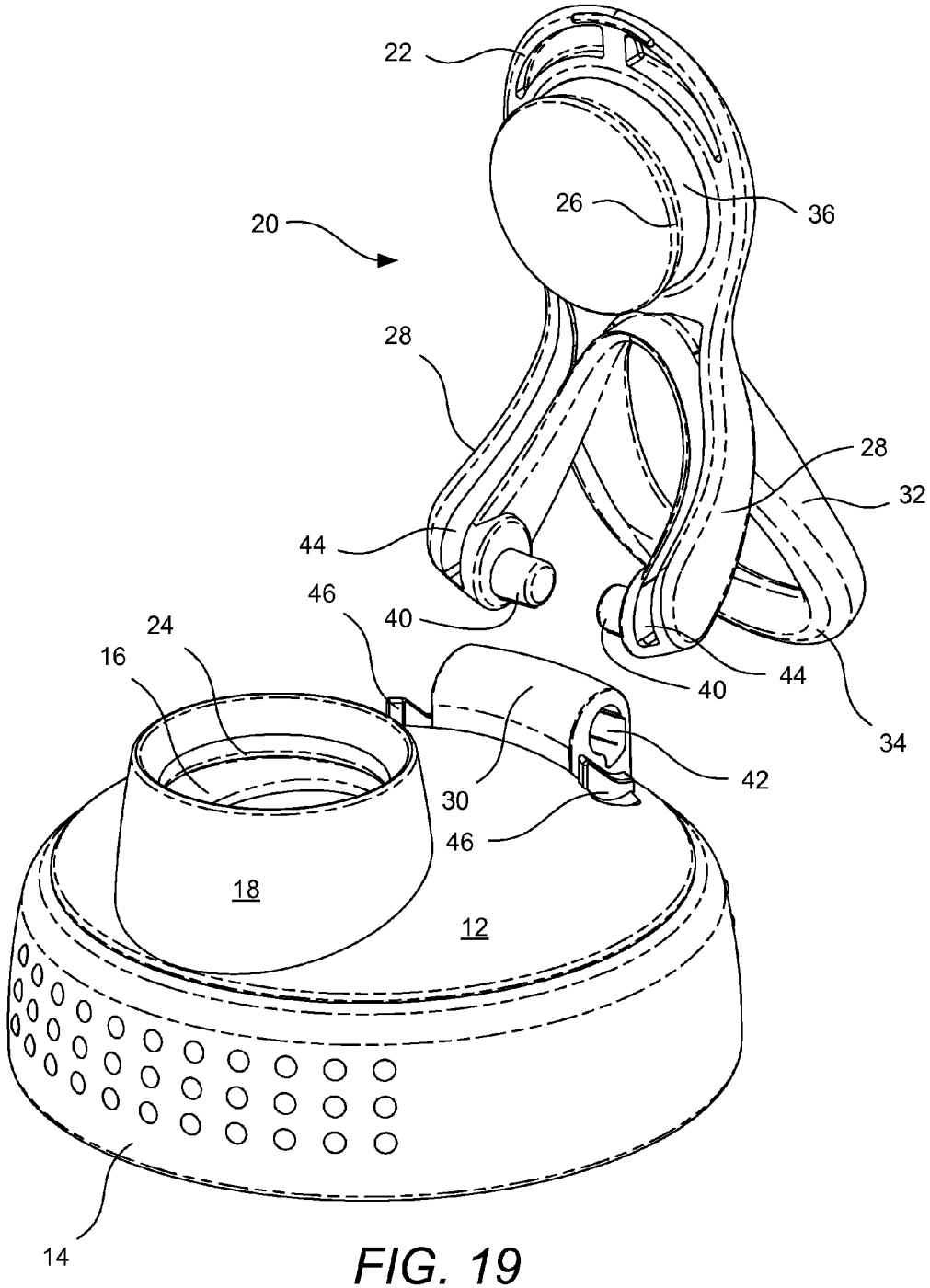
FIG. 19 shows an exploded perspective view of the embodiment of FIG. 10.

FIGS. 15, 16, and 19 illustrate an additional feature that is incorporated in some embodiments to secure the flip top 20 to the pivot hinge mount 30 so as to prevent the flip top 20 from disengaging when the bottle is carried by the carrying member 32 of the flip top 20. As may be seen in the exploded view of FIG. 19, the pivot support members 28 terminate in projecting tabs 40 configured to engage with pivot hinge holes 42 disposed in the pivot hinge mount 30. The projecting tabs 40 engage in the pivot hinge holes 42 and permit the flip top 20 to pivot around the pivot axis of the connection. When pressure is applied to the flip top 20 in such a direction as to tend to separate the flip top 20 from the rest of the closure, it tends to cause the pivot support members 28 to spread and allow one or both of the projecting tabs 40 to begin to exit the pivot hinge holes 42. If one or both projecting tabs 40 completely leave the pivot hinge holes 42, the flip top 20 separates from the remainder of the closure.

As such separation is undesirable, and as significant forces may be encountered when the bottle is full and is being carried by the flip top 20, this embodiment incorporates features designed to prevent the projecting tabs 40 from exiting the pivot hinge holes 42. Specifically, each of the pivot support members 28 are provided with a locking slot 44 configured to engage with a corresponding lock tab 46 disposed on the end wall 12 adjacent the pivot hinge holes 42. When the flip top 20 is in its second, open position as shown in FIGS. 15 and 16, the locking slots 44 do not engage the corresponding lock tabs 46, and the flip top 20 can be removed from the pivot hinge mount 30 by spreading the pivot support members 28, thus assuming the exploded configuration shown in FIG. 19.

Figure 12:
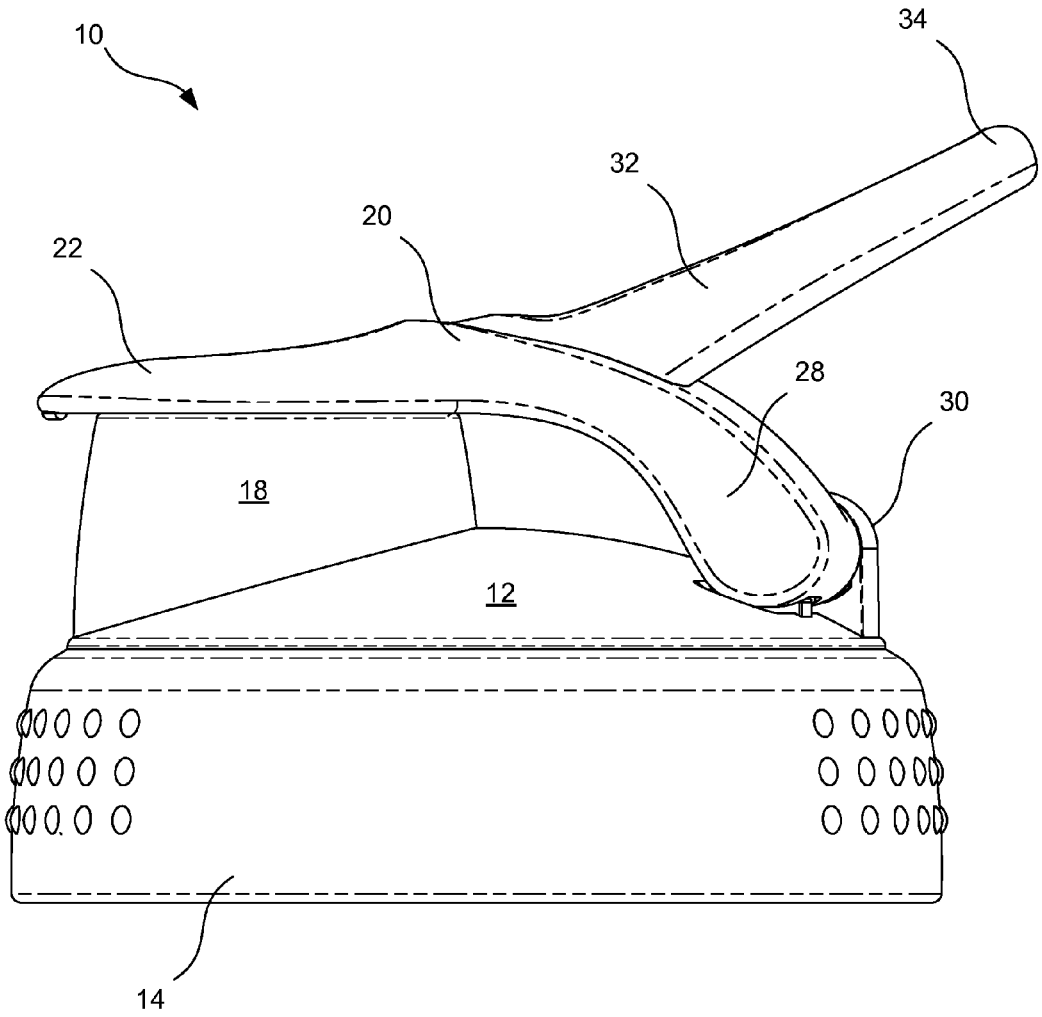
FIG. 12 shows a left-side view thereof.
Figure 13:
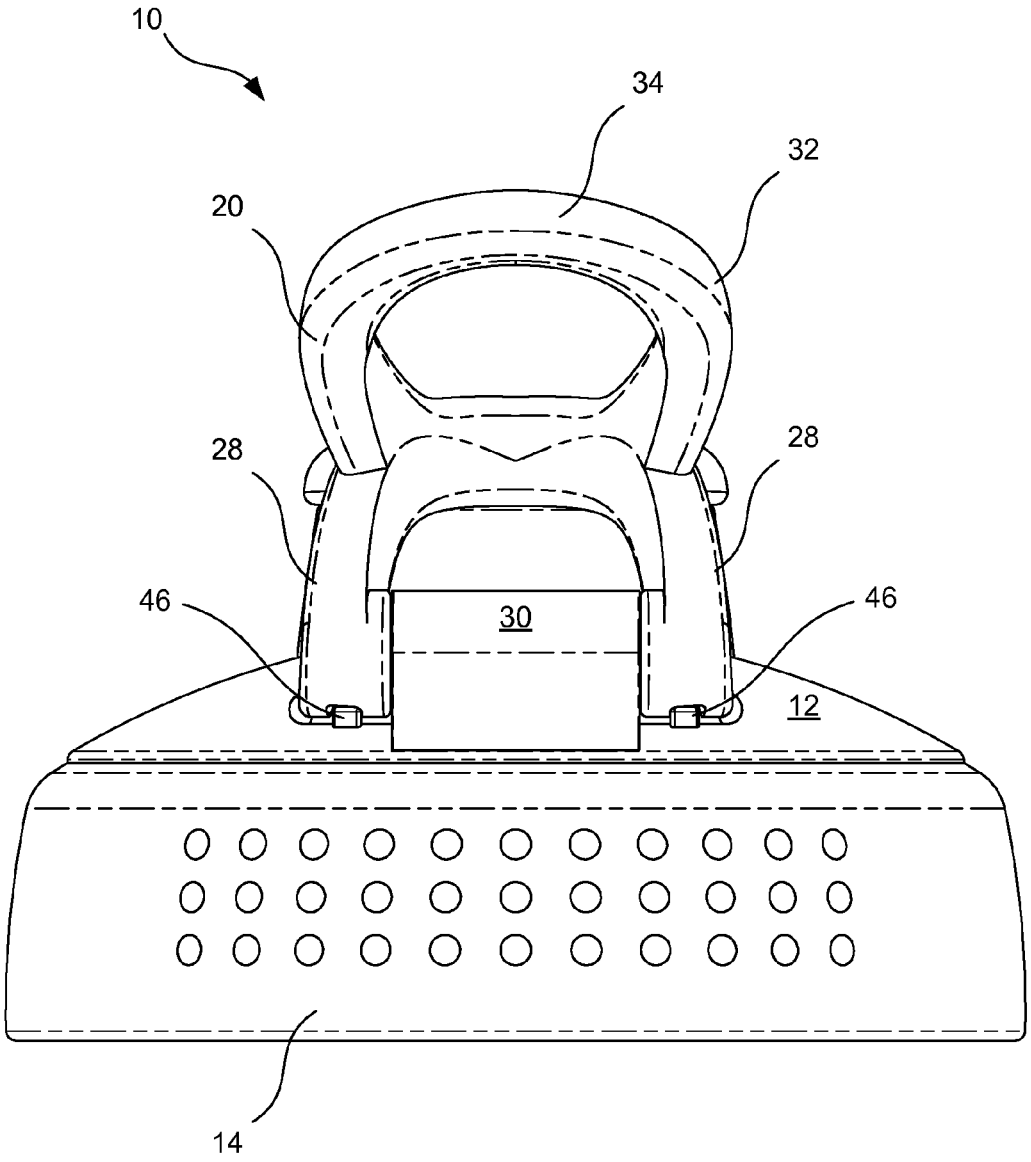
FIG. 13 shows a back view thereof.
Figure 14:
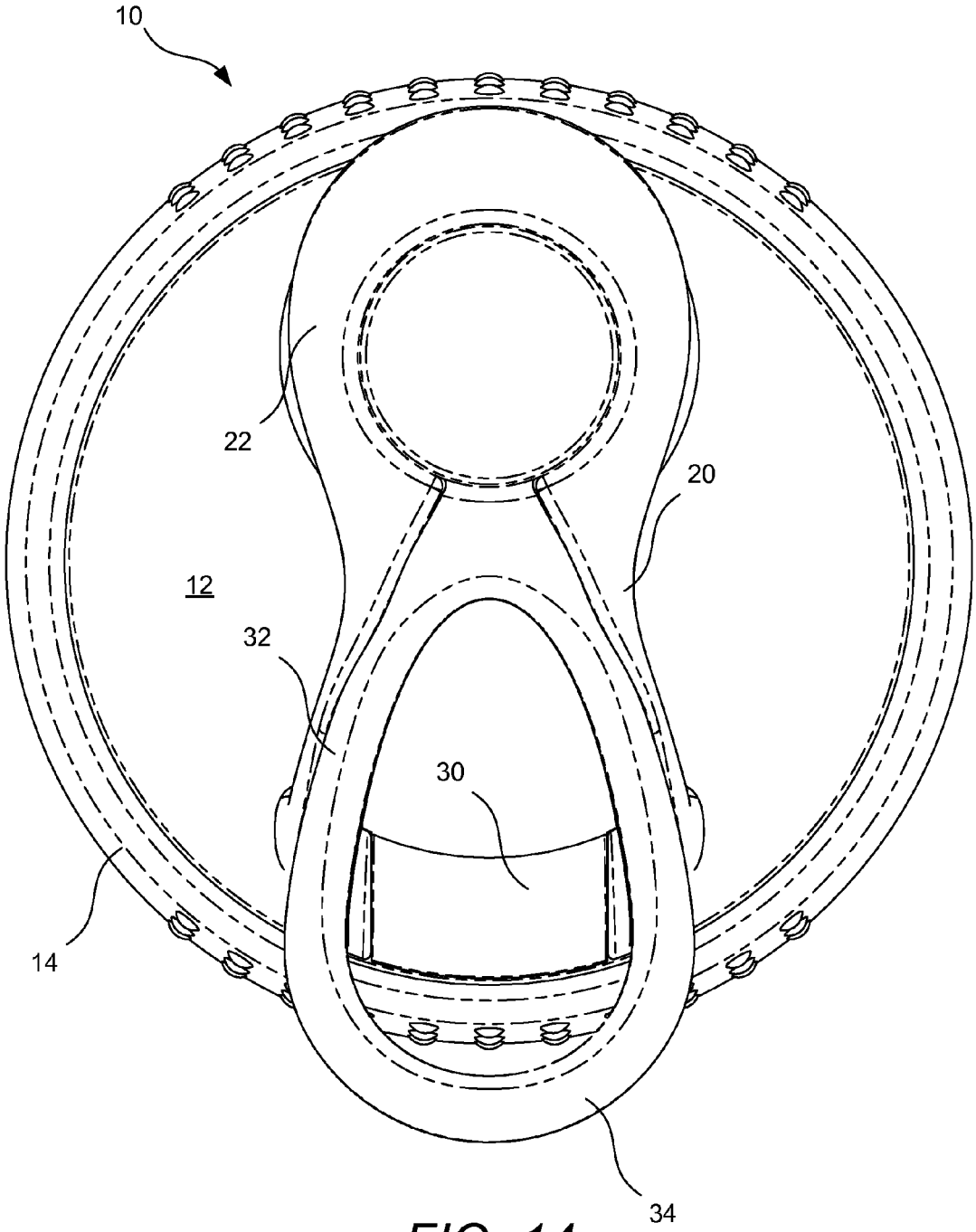
FIG. 14 shows a top view thereof.

Generally, the bottle will not be carried by the flip top 20 when the flip top 20 is in the open position. Instead, the flip top 20 is first closed as shown in FIGS. 12 and 13, whereby the locking slots 44 is rotated to engage the lock tabs 46. The engagement between the lock tabs 46 and the locking slots 44 prevents the pivot support members 28 from being spread. Thus, when the bottle is carried by the carrying member 32, the flip top 20 is better secured from unwanted separation from the remainder of the closure 10.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A closure having an integrated flip top handle for use with a liquid container and for carrying the liquid container, the closure comprising:

an end wall;

a generally circular skirt wall depending from the end wall;

an outlet opening in the end wall;

a pivot hinge mount connected to and extending upwardly from the end wall, the pivot hinge mount disposed within an outer perimeter of the end wall and within an outer perimeter of the generally circular skirt wall; and a flip top movable between a first position in which the outlet opening is closed to create a leak-proof seal and a second position in which the outlet opening is exposed, the flip top comprising:

a body including a first end and a second end, wherein an upwardly applied force on a lower portion of the first end of the body is used to move the flip top from the first position to the second position;

a pivot support member extending outwardly from the body at an angle, the pivot support member pivotally connected to the pivot hinge mount about an axis of rotation to allow the flip top to pivot between the first position and the second position, the axis of rotation generally aligned with an upper portion of the end wall;

a closing member disposed proximate the first end of the body, the closing member covering the outlet opening when the flip top is in the first position, the closing member spaced apart from the outlet opening when the flip top is in the second position, the closing member disposed on a first side of the axis of rotation when the closing member is in the first position; and a carrying member disposed proximate the second end of the body, the carrying member extending in an opposite direction from the closing member, the carrying member including a distal end that is disposed on an opposing second side of the axis of rotation when the closing member is in the first position.

2. The closure as recited in claim 1, wherein the carrying member comprises a carrying loop having an external diameter;

wherein the pivot support member comprises two spaced apart legs that pivotally connect the flip top to the pivot hinge mount; and wherein the external diameter of the carrying loop is at least as large as a distance between the two spaced apart legs of the pivot support member.

3. The closure as recited in claim 2, wherein the carrying loop is configured to receive at least one of:

a user's finger inserted through the carrying loop in a generally-vertical orientation;

a user's finger inserted through the carrying loop in a generally-horizontal orientation; and a user's finger inserted through the carrying loop in an orientation rotated between generally vertical and generally horizontal.

4. The closure as recited in claim 1, wherein the distal end of the carrying member extends outward and beyond the axis of rotation relative to the closing member; and wherein an upward force applied to the carrying member is translated into a downward force on the closing member.

5. The closure as recited in claim 1, wherein the outlet opening comprises a spout extending from the end wall, the spout spaced inwardly from the outer perimeter of the end wall; and wherein the pivot hinge mount is spaced inwardly from the outer perimeter of the end wall.

6. The closure as recited in claim 1, wherein the closing member comprises:

a generally tubular closure wall; and a plug seal supported by the closure wall, the plug seal being configured to seal with and close the outlet opening when the flip top is in the first position.

7. The closure as recited in claim 1, wherein the pivot support member comprises two portions that are pivotally attached to opposite sides of the pivot hinge mount.

8. The closure as recited in claim 1, wherein when the flip top is in the first position, the carrying member and closing member are orientated generally parallel to the end wall.

9. The closure as recited in claim 1, further comprising:

a pair of lock tabs disposed on opposing sides of the pivot hinge mount; and a pair of locking slots disposed in the pivot support member, the locking slots configured to selectively engage the lock tabs;

wherein the locking slots engage the lock tabs when the flip top is in the first position and the locking slots do not engage the lock tabs when the flip top is in the second position.

10. The closure as recited in claim 1, wherein the closing member, the pivot support member and the carrying member of the flip top are integrally formed as a unitary, one-piece structure.

11. The closure as recited in claim 1, wherein when the flip top is in the second position, the distal end of the carrying member extends to or below a lower end of the skirt wall.

12. The closure as recited in claim 1, wherein when the flip top is in the second position, the carrying member and the closing member are oriented generally perpendicular to the end wall.

13. A closure having an integrated, one-piece flip top handle for use with a liquid container and for carrying the liquid container, the closure comprising:

an end wall;

a generally circular skirt wall depending from the end wall;

an outlet opening in the end wall;

a pivot hinge mount connected to the end wall, the pivot hinge mount being positioned at an opposite side of the end wall from the outlet opening, the pivot hinge mount and the outlet opening disposed within an outer perimeter of the end wall and within an outer perimeter of the generally circular skirt wall; and a flip top pivotally supported by the pivot hinge mount, the flip top being movable between a first position in which the outlet opening is covered by the flip top and a second position in which the outlet opening is exposed, the flip top comprising:

a body including a first end and a second end, wherein an upwardly applied force on a lower portion of the first end of the body is used to move the flip top from the first position to the second position;

a pivot support member extending outwardly and downwardly from the body at an angle, the pivot support member pivotally attached to the pivot hinge mount about an axis of rotation;

a closing member disposed proximate the first end of the body, the closing member covering the outlet opening when the flip top is in the first position, the closing member spaced apart from the outlet opening when the flip top is in the second position, the closing member disposed on a first side of the axis of rotation; and a carrying loop disposed proximate the second end of the body, the carrying loop including a distal end that is disposed on an opposing second side of the axis of rotation;

wherein the body, the pivot support member, the closing member and the carrying loop are integrally formed as part of a unitary, one-piece structure; and wherein when the closure is connected to a container, the flip top is in the first position and the container is carried by the distal end of the carrying loop, a carrying force does not cause an opening force to be applied to the closing member.

14. The closure as recited in claim 13, wherein the carrying loop extends from an end of the pivot support member a distance that is at least as long as the distance between a first end and a second end of the pivot support member such that an upward force applied to the carrying loop is translated into a downward force on the closing member.

15. The closure as recited in claim 13, wherein the pivot support member comprises two portions that are pivotally attached to opposite sides of the pivot hinge mount.

16. The closure as recited in claim 13, wherein when the flip top is in the first position, the carrying member and closing member are orientated generally parallel to the end wall.

17. The closure as recited in claim 13, wherein the carrying loop extends upwardly relative to the closing member, the pivot support member extends downwardly relative to the closing member, the carrying loop and the pivot support member has a generally V-shaped configuration, and the carrying loop, the closing member and the pivot support member are integrally formed as part of a unitary, one-piece construction.

18. A closure for a container, the closure having an integrated flip top handle for carrying the container, the closure comprising:

an end wall;

a generally circular skirt wall depending from the end wall;

an outlet opening associated with the end wall;

an opening ridge disposed within the outlet opening;

a pivot hinge mount connected to the end wall, the outlet opening and the pivot hinge mount being integrally formed with the end wall as part of a unitary, one-piece structure, the pivot hinge mount disposed within an outer perimeter of the end wall and within an outer perimeter of the generally circular skirt wall;

a flip top pivotally supported by the pivot hinge mount about an axis of rotation, the flip top being movable between a first position in which the outlet opening is covered by the flip top and a second position in which the outlet opening is exposed, the flip top comprising:

a pivot support member attached to the pivot hinge mount;

a closing member that covers the outlet opening when the flip top is in the first position and exposes the outlet opening when the flip top is in the second position, the closing member comprising a closure wall, a plug seal and a closing member ridge, the closing member ridge and the opening ridge interacting to securely close the outlet opening and create a leak-proof seal; and a carrying member that extends in an opposite direction from the closing member, the pivot support member, the closing member and the carrying member being integrally formed as part of a unitary, one-piece structure.

19. The closure as recited in claim 18, wherein the carrying member comprises a loop;

wherein the pivot support member comprises two portions that are connected to opposite sides of the pivot hinge mount; and wherein a width of the loop is at least as large as a width of the pivot hinge mount.

20. The closure as recited in claim 18, wherein the carrying member comprises a loop, the loop having an external diameter that is at least as large as the distance between a first end and a second end of the pivot support member.

21. The closure as recited in claim 18, wherein the closing member and the pivot support member is at least substantially disposed on a first side of the axis of rotation when the flip top is in the first position;

wherein a distal end of the carrying member is disposed on a second side of the axis of rotation when the flip top is in the first position; and wherein the closing member, the pivot support member and the carrying member are disposed on the second side of the axis rotation when the flip top is in the second position.

* * * * *